US005289889A

United States Patent [19]

Gearhart et al.

[11] Patent Number: 5,289,889

[45] Date of Patent: Mar. 1, 1994

[54] ROLLER CONE CORE BIT WITH SPIRAL STABILIZERS

[76] Inventors: Marvin Gearhart, 4001 Hildring Ct., Forth Worth, Tex. 76109; Johnny N. Castle, 812 Sterling La., Crowley, Tex. 76036; Paul G. Parys, 6708 Watermill Dr., Fort Worth, Tex. 76132

[21] Appl. No.: 7,257

[22] Filed: Jan. 21, 1993

[51] Int. Cl.[5] ..... E21B 17/10

[52] U.S. Cl. ..... 175/325.5; 175/408

[58] Field of Search ..... 175/325.1, 325.3, 325.5, 175/331, 336, 394, 408, 412, 426

[56] References Cited

U.S. PATENT DOCUMENTS

| | | | |
|---|---|---|---|
| 4,245,709 | 1/1981 | Manuel | 175/325.5 |
| 4,277,869 | 7/1981 | Hartwell | 175/408 X |
| 4,630,690 | 12/1986 | Beasley et al. | 175/325.5 X |
| 5,058,689 | 10/1991 | Collinsworth | 175/408 X |

*Primary Examiner*—Thuy M. Bui

*Attorney, Agent, or Firm*—Arnold, White & Durkee

[57] ABSTRACT

This invention relates to an improved roller cone coring bit that includes spiral stabilizer blades on the bit body. The spiral stabilizer blades reduce the whirling tendency of the bit, thereby enhancing the ability to cut and recover a continuous core.

5 Claims, 1 Drawing Sheet

ROLLER CONE CORE BIT WITH SPIRAL STABILIZERS

BACKGROUND OF THE INVENTION

This invention relates to an improved roller cone coring bit used to cut a core of a subterranean formation. More particularly, the improved design includes the use of spiral stabilizer blades to stabilize the bit and thereby enhance the ability to cut and recover a continuous core of a reservoir rock.

Analysis of core samples yields important geological information about subterranean formations. There are two basic methods of obtaining a core sample. Coring may be done at the time of drilling or sidewall core samples may be taken after the hole has been drilled. Coring at the time of drilling utilizes some type of open center bit which cuts a donut-shaped hole, leaving a cylindrical plug or core in the center. As drilling progresses, the central plug or core rises inside a hollow tube or core barrel above the bit where it is captured and subsequently retrieved at the surface. Coring bits come in three basic varieties: diamond core heads, polycrystalline diamond core heads, or roller cone coring bits. This invention relates to an improved roller cone coring bit.

Roller cone coring bits tend to drill a slightly oversized borehole. The slightly oversized borehole creates an exaggerated rotation pattern for the core bit. Due to the relatively low tensile strength of most rock, the exaggerated rotation, or whirl, tends to break or shear the core. This is undesirable for several reasons. The inner core barrel may become jammed thereby preventing the recovery of additional core. Alternatively, only fragmented pieces of a core will be recovered which reduces the quality and quantity of information that can be obtained from the core.

With conventional roller cone coring bits, only the cone cutters extended to the gage diameter of the borehole. The bit body and the journal arm segments are smaller than the gage diameter of the borehole. To reduce the effects of the whirling motion, coring companies have attempted to stabilize the outer core barrel above the core bit. However, this did not eliminate the whirling action. Although relatively close to the bit, the stabilizer on the outer core barrel acted as a fulcrum point. This created a moment on the core bit, which increased the tendency to drill an oversized borehole.

To overcome the above problem, stabilizer pads were welded onto the body of the core bit. These pads tended to be square in shape and proved to be marginally successful. The stabilizer pads on the bit body tended to reduced the whirling motion and the fulcrum effect. However, laboratory testing showed that the straight vertical leading edge of the square pads would engage the borehole wall in such a manner to actually increase the whirling motion of the bit under certain conditions. When these conditions occur, the square stabilizer pads are actually detrimental to coring.

This invention overcomes the problems described above. The roller cone core bit of the present invention includes spiral stabilizer blades. The proximity of the stabilizer blades to the cutting elements, i.e., the cone cutters, reduces the tendency to drill an oversized hole. In addition, the spiral shaped stabilizer blades are less likely to hang up on the borehole wall than the prior art square stabilizer pads. As a result, a smoother drilling action is accomplished. The smoother drilling action enhances the ability to recover a continuous core.

SUMMARY OF THE INVENTION

This invention relates to an improved roller cone coring bit. More particularly, the improved roller cone coring bit has a bit body which includes spiral stabilizer blades. The spiral stabilizer blades extend to substantially the bit diameter, thereby stabilizing the core bit during coring operations. The addition of the spiral stabilizer blades to the core bit reduces the whirling tendency of the bit, thereby enhancing the ability to cut and recover a continuous core.

DESCRIPTION OF THE PREFERRED EMBODIMENTS

Figure 1:
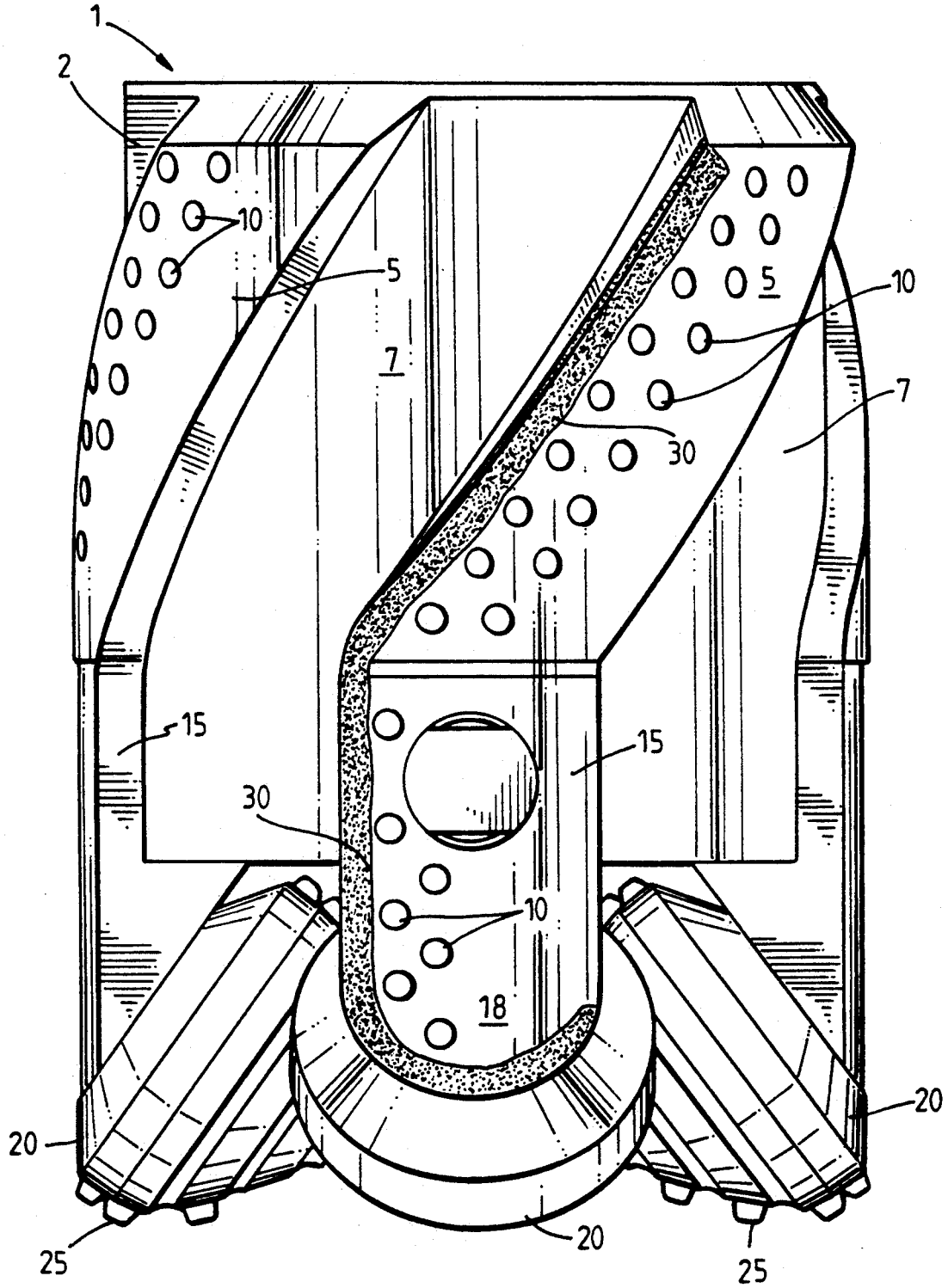
FIG. 1 is a side view of a preferred embodiment of the present invention.

Referring to FIG. 1, core bit 1 has an internally threaded box (not shown) on its upper end for securing the core bit to the core barrel and drillstring. Core bit 1 has a plurality of journal segment arms 15 on its lowermost end. A rolling cone cutter 20 with a cutting structure consisting of wear resistent inserts 25, is rotatably mounted and secured on a journal (not shown) which extends downward and inward from the bottom of each journal segment arm 15. A plurality of frusto-conical cone cutters 20 drill a doughnut shaped hole, leaving a cylindrical plug or core in the center. As drilling progresses, the core rises inside a hollow tube or core barrel above the core bit 1 (not shown) where it is captured and subsequently retrieved at the surface. The core bit shown in FIG. 1 includes four rolling cone cutters. Larger diameter core bits may utilize more than four cone cutters.

The upper end of journal segment arms 15 are securely affixed to the lower end of cylindrical bit body 2. Journal segment arms 15 and bit body 2 have a diameter smaller than the gage diameter of the core bit. Stabilizer blades 5 extend radially from bit body 2. The stabilizer blades are spirally oriented about the longitudinal axis of core bit 1. The width of stabilizer blade 5, as illustrated in FIG. 1, is substantially the same as journal segment arm 15. The stabilizer blades, however, may be constructed with any desired width. Stabilizer blade 5, as shown in FIG. 1, abuts the upper end of journal segment arm 15 and spirals along the remaining length of bit body 2. The spiral stabilizer blades, however, may be constructed with any desired length.

The stabilizer blades depicted in FIG. 1 extend radially to substantially the gage diameter of the core bit. Other embodiments of the claimed invention may include slightly under gage stabilizer blades. The stabilizer blades may be oriented in a relatively loose spiral or tight spiral depending on the amount of wall contact desired with the borehole. A tightly spiraled configuration may have up to 360° of wall contact with the borehole.

Junk slot 7 is created by the space between adjacent stabilizer blades. Junk slot 7 provides a passageway for the circulation of the drilling mud and removal of drill cuttings. The depth of junk slots 7 are determined by the height of the stabilizer blades above the bit body.

The wear resistance of the stabilizer blades may be enhanced by the insertion of wear resistent inserts into the stabilizer blades. Tungsten carbide inserts 10 are illustrated in FIG. 1. In addition, the leading edge of the stabilizer blade may be hardfaced to provide further wear resistent protection. Hardfacing 30 is shown in FIG. 1. Hardfacing and/or wear resistent inserts may also be used with journal segment arms 15 and shirt sleeves 18.

A preferred embodiment of the present invention utilizes integral blade stabilizers. Weld-on blades or replaceable wear pads may also be used so long as the blades are arranged spirally about the longitudinal axis of the core bit.

It will be understood by those skilled in the art that certain variations and modifications can be made without departing from the spirit and scope of the invention as defined herein and in the appended claims.

We claim:

1. An improved roller cone core bit comprising:

a cylindrical bit body having a means for connecting the core bit to a drillstring on one end and a plurality of journal segment arms on the other end;

a plurality of core cutters, the cone cutters being rotatably mounted on journals which extend downward from the journal segment arms; and a plurality of stabilizer blades fixedly attached to the circumference of the bit body, each stabilizer blade oriented spirally about the longitudinal axis of the bit body.

2. The improved roller cone core bit of claim 1 wherein the stabilizer blades contain tungsten carbide inserts.

3. The improved roller cone core bit of claim 1 wherein the stabilizer blades have hardfacing on their leading edge.

4. The improved roller cone core bit of claim 1 wherein the stabilizer blades extend to substantially the diameter of the core bit.

5. The improved roller cone core bit of claim 1 wherein the stabilizer blades provide substantially 360 degrees of wall contact with a full gage borehole.

* * * * *